United States Patent [19]

Ohara et al.

[11] Patent Number: 4,723,601

[45] Date of Patent: Feb. 9, 1988

[54] MULTI-LAYER TYPE HEAT EXCHANGER

[75] Inventors: Toshio Ohara, Kariya; Kiyomitsu Tsuchiya, Okazaki; Kiyoshi Kittaka, Aichi; Yasuhiro Sudo, Okazaki; Yoshiyuki Yamauchi, Aichi; Yoshio Miyata, Nagoya, all of Japan

[73] Assignee: Nippondenso Co., Ltd., Japan

[21] Appl. No.: 843,373

[22] Filed: Mar. 24, 1986

[30] Foreign Application Priority Data

| | | | |
|---|---|---|---|
| Mar. 25, 1985 | [JP] | Japan | 60-60488 |
| Mar. 28, 1985 | [JP] | Japan | 60-84749 |
| Jan. 10, 1986 | [JP] | Japan | 61-3742 |

[51] Int. Cl.[4] ..... F28D 1/02

[52] U.S. Cl. ..... 165/153; 165/166; 165/176

[58] Field of Search ..... 165/149, 153, 176, 166

[56] References Cited

U.S. PATENT DOCUMENTS

| | | | |
|---|---|---|---|
| 3,258,832 | 7/1966 | Gerstung | 165/176 X |
| 3,262,496 | 7/1966 | Bawabe | 165/166 |
| 4,217,953 | 8/1980 | Sonoda et al. | 165/176 X |
| 4,327,802 | 5/1982 | Beldam | 165/166 X |
| 4,423,772 | 1/1984 | Dahlgren | 165/166 |
| 4,487,038 | 12/1984 | Iijima | 165/166 X |
| 4,605,060 | 8/1986 | Andersson et al. | 165/166 |

FOREIGN PATENT DOCUMENTS 53-32376 8/1978 Japan .

*Primary Examiner*—Albert W. Davis, Jr.
*Assistant Examiner*—Richard R. Cole

[57] ABSTRACT

A multi-layer type heat exchanger is formed by a row of parallel flat tubes each having tank portions spaced widthwise of the flat tube and disposed adjacent to one end thereof. Each tube defines therein a passage for a heat transfer fluid extending from one tank portion towards the other end of the tube and is then turned to the other tank portion. The flat tubes are stacked such that the tank portions are connected together in fluid-flow communication with each other. The portions of each adjacent pair of tubes excepting the tank portions are spaced apart to accommodate a corrugated fin. Each tube is formed by two press-worked core plates soldered together to form the passage in the tube. Two adjacent core plates of each adjacent pair of tubes have bent end portions extending to and engaged with each other or integrally connected together to support the other ends of the adjacent tubes in spaced relationship to accommodate the fin therebetween.

8 Claims, 19 Drawing Figures

MULTI-LAYER TYPE HEAT EXCHANGER

FIELD OF THE INVENTION

The present invention relates to an improvement in the construction of a multi-layer type heat exchanger which is suitable for use as, for example, an evaporator of an automotive air conditioner.

DESCRIPTION OF THE PRIOR ART

An example of the multi-layer type heat exchanger is shown in Japanese Utility Model Examined Publication No. 32376/1978. This heat exchanger has a row of a plurality of flat tubes each having a couple of tank portions on its one end, and a row of a plurality of corrugated fins each interposed between adjacent flat tubes. The flat tubes and the corrugated fins are arranged alternatingly in layers such that each corrugated fin is sandwiched between adjacent flat tubes. In order to maintain a constant space between each adjacent pair of the flat tubes, the other ends of the flat tubes remote from the tank portions are received in notches or grooves formed at a regular interval in a plate-like supporting member.

In the production of this type of heat exchanger, the flat tubes, corrugated fins and the supporting member are provisionally assembled with a suitable brazing material placed between adjacent members. Then, the assembly, while being held in this state by a suitable jig, is placed in a brazing furnace in which these parts are heated and brazed to one another to complete a heat exchanger.

With this structure of the heat exchanger, problems such as disarray of the parallel flat tubes and collapse of corrugated fins by external force, which may occur after the brazing, can be avoided by the use of the supporting member which rigidly supports and spaces the ends of the flat tubes remote from the tank portions. However, the use of the supporting member involves an additional cost for fabrication and assembly of the supporting member. In fact, the efficiency of the assembling of the heat exchanger is seriously impaired due to difficulty in arraying and keeping the ends of the flat tubes in conformity with the pitch of the notches formed in the supporting member.

SUMMARY OF THE INVENTION

Accordingly, an object of the invention is to provide a multi-layer type heat exchanger which can be assembled quickly and easily without requiring the use of additional part such as the supporting member employed in the known heat exchanger while the other ends of flat tubes are spaced at a pitch or interval.

The multi-layer type heat exchanger according to the present invention includes a row of a plurality of substantially parallel flat tubes each formed by two press-worked core plates sealingly jointed together. Each flat tube includes a pair of tank portions spaced widthwise of the flat tube and formed by protrusions formed in one end of each of the two core plates of the flat tube and protruding laterally outwardly of the flat tube. The protrusions on each core plate defines therein holes providing inlet and outlet for a heat transfer fluid. Each flat tube defines therein a passage for the heat transfer fluid. The passage is communicated at opposite ends with the tank portions and arranged such that the heat transfer fluid flows from one tank portion into the passage towards the other end of the flat tube and is then turned and flows to the other tank portion. The flat tubes are successively stacked in the direction of the thickness of each flat tube so that the protrusions on each core plate of each flat tube, excepting the outermost core plates, abut against the protrusions of an adjacent core plate of an adjacent flat tube and the holes in the abutting protrusions are sealingly connected with each other. Adjacent core plates of each adjacent pair of flat tubes have bent end portions which extend towards and are engaged with each other or integrally connected together to support, in spaced relationship, the other ends of the adjacent flat tubes in the direction of the thicknesses thereof.

The bent end portions of adjacent core plates of each adjacent pair of flat tubes advantageously act as a spacer. Thus, the heat exchanger according to the present invention does not require any spacer member prepared separately of the core plates and, therefore, can be easily manufactured without the problems and difficulties of the prior art. Thus, the present invention advantageously reduces the cost of manufacture.

The above and other objects, features and advantages of the invention will made more apparent by description of preferred embodiments with reference to the accompanying drawings.

DESCRIPTION OF THE PREFERRED EMBODIMENTS

Figure 1:
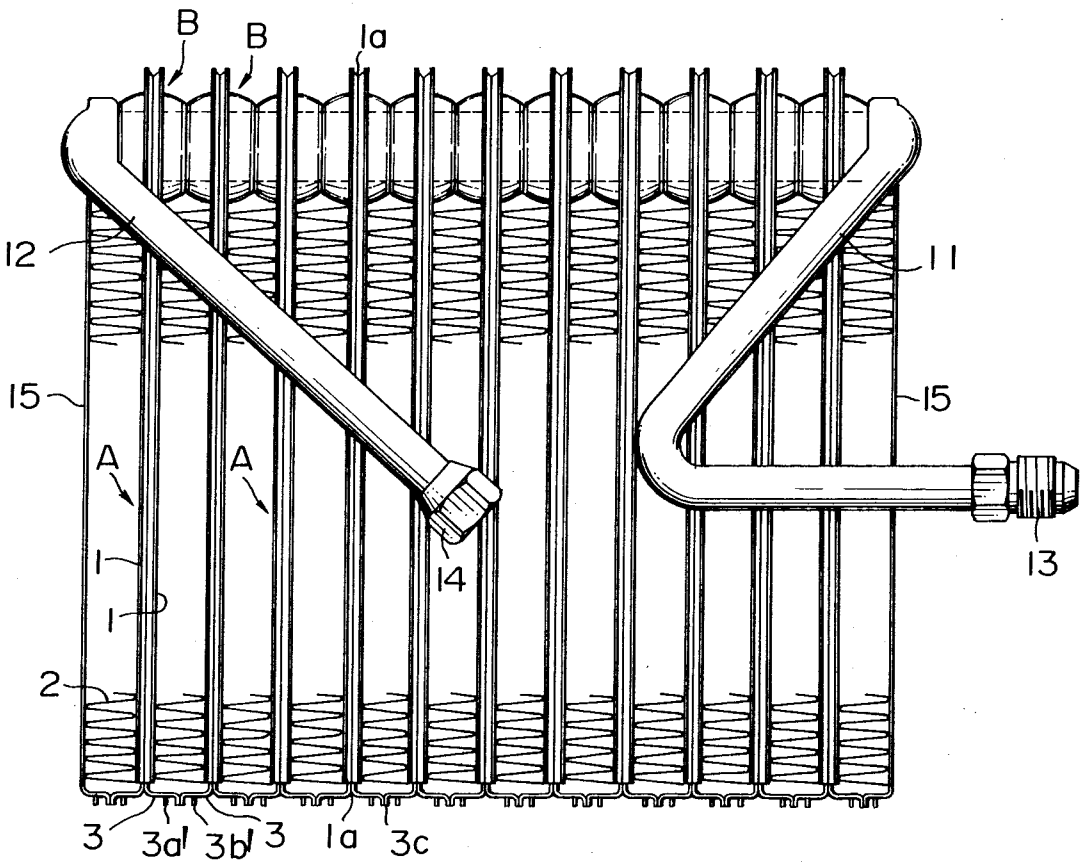
FIG. 1 is a front elevational view of an automotive air conditioner evaporator embodying a heat exchanger according to the invention.

Referring to FIG. 1, an evaporator of an automotive air conditioner, which is an embodiment of a heat exchanger in accordance with the invention, comprises a plurality of flat tubes A each defining therein a passage for the flow of refrigerant serving as a heat transfer medium. A pair of tank portions B are formed on one longitudinal end of the flat tube A. Each flat tube A is constituted by a pair of core plates 1 which are jointed to each other. The evaporator further has a plurality of corrugated fins 2 each interposed between adjacent flat tubes A so as to increase the heat transfer area. Each corrugated fin 2 is formed by folding or corrugating a thin sheet of, for example, aluminum. The end portion of each core plate 1 remote from the tank portions B is bent as at 3 at about 90° such that the bent end portions 3 of adjacent flat tubes A abut each other. Thus, the bent end portions 3 of adjacent flat tubes A serve as spacers which preserve a predetermined gap between these flat tubes A at the ends remote from the tank portions B. The bent end portions 3 have projections 3*a*′ and 3*b*′ which constitute parts of engaging protrusions and recesses which will be mentioned later. The evaporator further has refrigerant outlet and inlet pipes 11 and 12. The refrigerant outlet pipe 11 is connected through a pipe joint 13 to a suction pipe (not shown) of a refrigerator compressor so that gaseous refrigerant from the evaporator is sucked by the compressor. The refrigerant inlet pipe 12 is connected through a pipe joint 14 to a pressure reducing means, e.g., an expansion valve (not shown), of the refrigerator. Numerals 15 denote side plates disposed on the left and right ends of the evaporator as viewed in FIG. 1 so as to protect the assembly constituted by the flat tubes and corrugated fins. Each side plate 15 is clad with a brazing material only on the surface thereof facing the corrugated fin 2.

Figure 2:
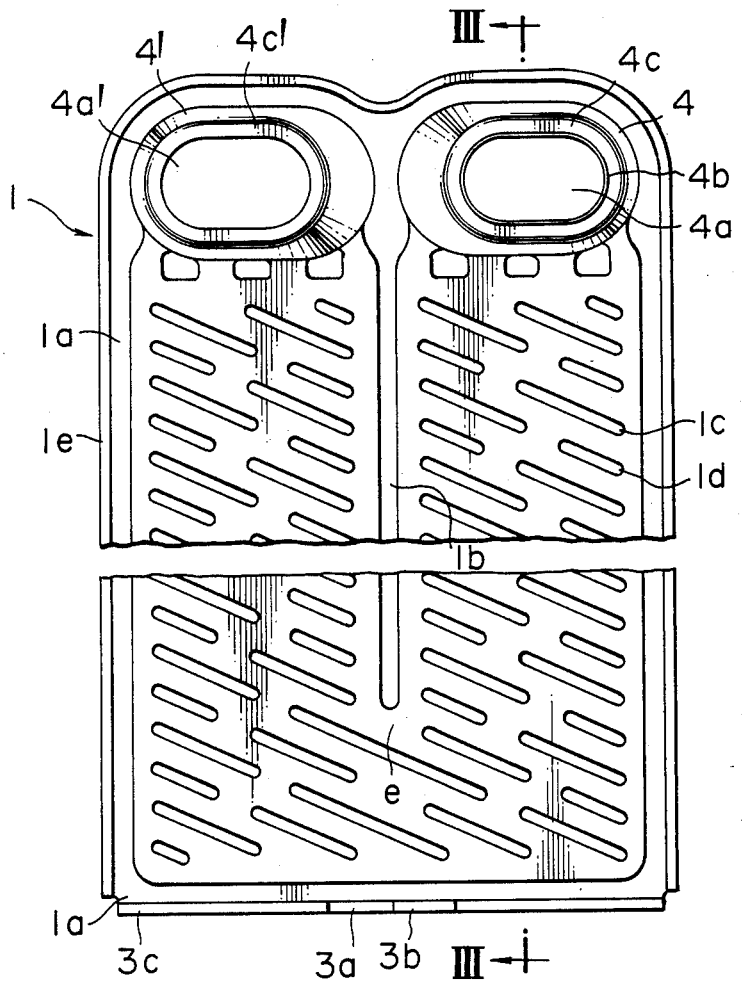
FIG. 2 is a front elevational view of a core plate which forms a part of a flat tube which in turn is an essential part of the evaporator shown in FIG. 1.
Figure 3:
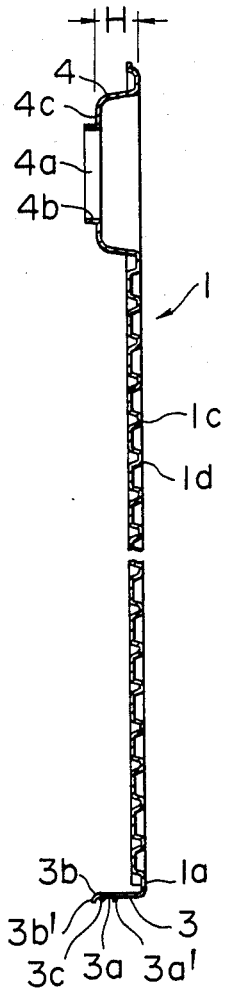
FIG. 3 is a sectional view taken along the line III—III in FIG. 2.
Figure 4:
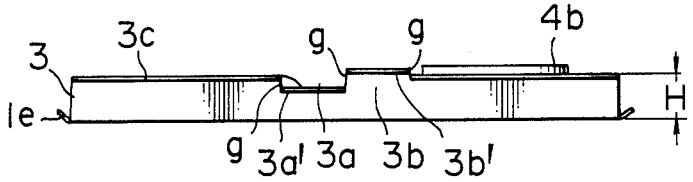
FIG. 4 is a bottom view of the core plate.

Two core plates 1 constituting each flat tube A are symmetrical in shape with each other. The front elevation of one of these core plates 1 is shown in FIG. 2. FIGS. 3 and 4 are a sectional view taken along the line III—III in FIG. 2 and a bottom view of the core plate, respectively. The core plate 1 is formed by a press work from a sheet of a metal such as aluminum and has its both sides clad with brazing material for the assembly of an evaporator which is conducted by brazing in a manner explained later. The core plate 1 is provided at its upper end as viewed in FIG. 2 with a pair of outward protrusions 4 and 4′ for forming the tank portions B. As will be seen from FIG. 2, the protrusions 4 and 4′ are arranged side-by-side. Holes 4*a* and 4*a*′ are formed in the tops of the protrusions 4 and 4′ to constitute either a refrigerant inlet hole or a refrigerant outlet hole of the flat tube A. A reference numeral 4*b* denotes a flange formed along the peripheral edge of one of the holes 4*a* and 4*a*′. In the illustrated embodiment, the flange 4*b* is formed along the edge of the right hole 4*a* as viewed in FIG. 2. The other hole, i.e., the left hole 4*a*′ as viewed in FIG. 2, is devoid of such flange. This hole 4*a*′ is adapted to receive the flange 4*b* of the protrusion 4 of the adjacent core plate 1 Similarly, the flange 4*b* of the right protrusion 4 is adapted to be received in the flange-less hole 4*a*′ in the protrusion 4′ of the adjacent core plate 1. Thus, adjacent flat tubes A are held together at their upper ends as viewed in FIG. 1, with the tops 4*c* and 4*c* of the protrusions 4 and 4′ of their core plates abutting each other so as to maintain a predetermined gap between these flat tubes A. That is, the gap between the adjacent flat tubes A at their upper ends is determined by the height H (see FIG. 3) of the tops 4*c* and 4*c*′ of the protrusions 4 and 4′.

Referring to FIG. 2, the core plate 1 has a peripheral flat joint surface 1*a* used for brazing and a central longitudinal partitioning protrusion 1*b* formed in the central portion of the core plate 1 to form a substantially U-shaped refrigerant passage in a completed flat tube A. The portion denoted by "e" is devoid of the partitioning protrusion 1*b* and, therefore, permits the refrigerant to pass therethrough. The refrigerant is introduced into the flat tube A through one 4*a* (or 4*a*′) of the holes adjacent to one end of the flat tube A and flows along the partitioning protrusion 1*b* towards the other end of the flat tube A, i.e., towards the lower end as viewed in FIG. 2. Then, after making a U-turn at the portion "e" of the flat tube A as viewed in FIG. 2, the refrigerant flows towards the one, i.e., upper end of the flat tube A and is discharged through the outlet hole 4*a*′(or 4*a*). A plurality of ribs 1*c* and 1*d* are formed on the core plate 1 so as to project inwardly of the flat tube A, thus providing refrigerant labyrinth passages and reinforcing the core plate 1. A reference numeral 1*e* indicates a peripheral flange which is formed by bending the outer edge of the flat joint surface 1*a* slightly outwardly to stiffen the joint surface 1*a* to thereby assure a high flatness of the joint surface 1*a*.

The bent end portion 3 along the lower end of each core plate 1 as viewed in FIG. 2 serves as a spacer which preserves a required gap between the lower ends of adjacent flat tubes A while connecting them to each other. In the illustrated embodiment, the bent end portion 3 is formed by outwardly bending the lower end portion of the flat tube A at a right angle to the main portion of the core plate 1. This extreme end 3*c* provides a brazing joint surface which is brazed to a mating joint surface 3*c* of a core plate 1 of an adjacent flat tube A. The height H of the brazing surface 3*c* on the bent end portion 3 (see FIG. 4) is selected to be equal to the height H of the tops 4*c* and 4*c*′ of the protrusions 4 and 4′ (see FIG. 3). Thus, in the assembled state of the evaporator, the joint surfaces 3*c* on the bent end portions 3 of adjacent core plates 1 of adjacent flat tubes A abut each other at the mid point between these flat tubes. In consequence, a gap, which is of the same size as that defined between the upper end portions of the adjacent flat tubes A, is preserved between the lower end portions of the flat tubes A.

Numerals 3*a* and 3*b* denote, respectively, an engaging recess and an engaging projection formed in the bent end portion 3. These recess and projection 3*a* and 3*b* are formed by cutting the free edge of the bent end portion 3 at a suitable interval as at g, and bending the region between adjacent cuts g. Numerals 3*a*′ and 3*b*′ denote bent ends of these recess and projection 3*a* and 3*b*. In the assembled state, the engaging recess 3*a* of one core plate 1 receives the engaging projection 3*b* on the bent end portion 3 of the core plate 1 belonging to an adjacent flat tube A, while the engaging projection 3*b* of the one core plate 1 is received in the engaging recess 3*b* in the bent end portion 3 of the core plate 1 belonging to the adjacent flat tube A. The mutual engagement between the engaging recesses 3*a* and engaging projections 3*a* of adjacent core plates 1 effectively prevents the lower ends of these core plates 1 from sliding relative to each other in the direction of the planes of the core plates 1.

Each of the side plates 15 provided on each side of the evaporator is also provided at its lower end with a bent end portion 3 having an engaging recess 3*a* and an engaging projection 3*b*, as will be seen from FIG. 1.

Figure 5:
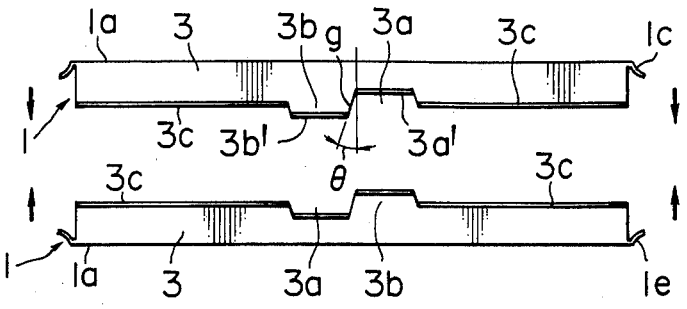
FIG. 5 is a bottom view of a pair of core plates which form halves of adjacent flat tubes, the core plates being shown in spaced relationship taken before they are assembled.

FIG. 5 is a bottom view of core plates 1 which constitute halves of two adjacent flat tubes A in the state before the core plates 1 are jointed to each other. The core plates 1 are positioned such that their engaging recesses 3*a* and engaging projections 3*b* are aligned. In FIG. 5, a symbol $\theta$ represents the angle formed between a cut g and a line which is perpendicular to the edge line of the bent end portion 3. It will thus be seen that the engaging recess 3*a* and the engaging projection 3*b* have trapezoidal forms.

Figure 6:
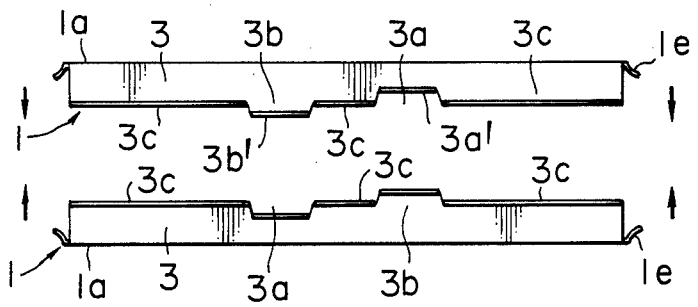
FIG. 6 is similar to FIG. 5 but shows a modification to the core plates shown in FIG. 5.

FIG. 6 shows a modification to the core plates 1 shown in FIG. 5, in which the modified core plates each have engaging recess and projection 3*a* and 3*b* spaced by a part of the joint surface 3*c*.

Figure 7:
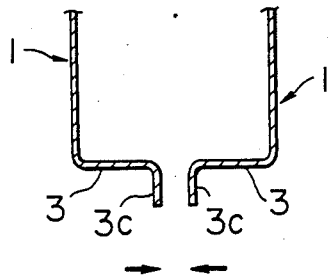
FIG. 7 is a fragmentary sectional side elevation of the lower end portions of a pair of core plates disposed in spaced relationship taken before they are assembled.
Figure 8:
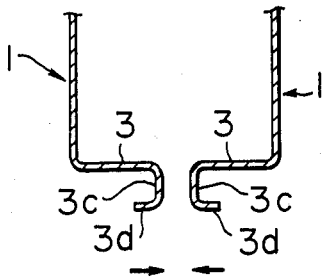
FIG. 8 is similar to FIG. 7 but illustrates a modification to the core plates shown in FIG. 7.

FIG. 7 is a vertical sectional view of the lower end portions of two core plates 1 which constitute halves of adjacent flat tubes A, the plates 1 being shown in the state before they are jointed to each other. In this case, the end extremities of the bent end portions 3 of both core plates 1 are simply bent downwardly so as to provide straight joint surfaces 3*c*. FIG. 8 shows another example in which the lower end extremities of the joint surfaces 3*c* are further bent away from each other to provide reinforcement flange portions 3*d*.

Figure 9:
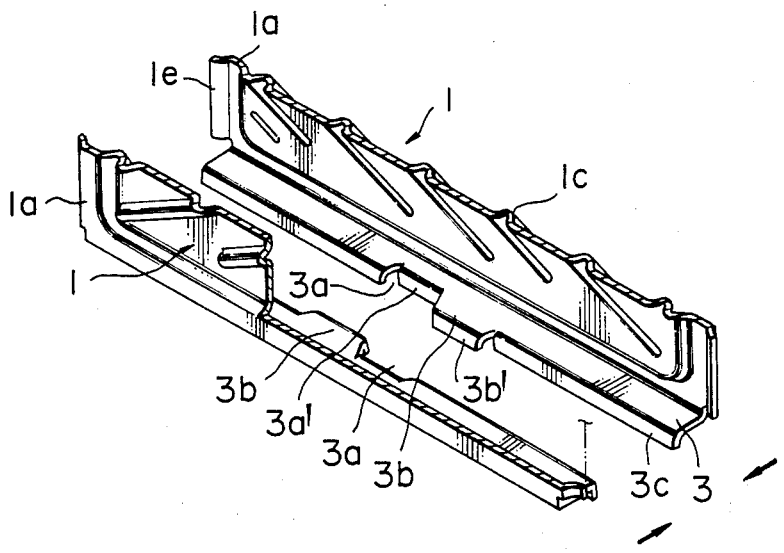
FIG. 9 is a fragmentary perspective view of the lower end portions of the core plates shown in spaced relationship taken before they are assembled.

FIG. 9 is a fragmentary perspective view of lower end portions of two core plates 1 constituting halves of adjacent flat tubes A, the core plates being of the type shown in FIGS. 1 to 5.

Steps of manufacture of the heat exchanger of the invention will be described with reference to the accompanying drawings. The constituent elements or members such as the core plates 1 having the construction explained in connection with FIGS. 2 to 9, corrugated fins 2 for increasing the heat transfer area, and two side plates 15 are prepared separately. The core plates 1 are beforehand clad with a brazing material on both sides thereof. The corrugated fins, however, are not clad with the brazing material. The side plates are clad with the brazing material only on their sides which are to contact the corrugated fins 2. These constituent members are then assembled together in a manner shown in FIG. 1. Namely, a first corrugated fin 2 is placed between the clad side of one of the side plates 15 and one side of a first core plate 1 constituting one half of a first flat tube A. Then, a second core plate 1 constituting the other half of the first flat tube A is placed on the other side of the first core plate 1 and assembled therewith. Similarly, further corrugated fins 2 and further core plates 1 are arranged alternatingly in layers and, finally, the other side plate 15 is placed on the outer side of the final corrugated fin 2 with the clad side of the other side plate 15 contacting the fin 2, thus completing assembly of the multi-layer heat exchanger. After connecting the refrigerant outlet and inlet pipes 11 and 12 to the outermost tank portions B, these constituent members are provisionally secured together by suitable jigs to fix the assembly which is then placed and held for a predetermined time in a heating furnace kept at a temperature higher than the melting temperature of the brazing material. In consequence, the brazing material is molten to braze the adjacent constituent parts and, after a cooling, the brazing material is set to rigidly secure the parts of the assembly, thus completing the manufacture.

When the core plates 1 and the corrugated fins 2 are assembled in layers during the manufacture of the heat exchanger, a constant gap is formed between each adjacent flat tubes A at each of the upper and lower portions of these flat tubes A. Namely, at the upper portions of the flat tubes A where the tank portions B are provided, the tops 4*c* and 4*c*' of the protrusions 4 and 4' on two adjacent core plates 1 constituting halves of two adjacent flat tubes A abut each other with the flange portions 4*b* on the peripheral edges of the refrigerant inlet or outlet holes 4*a* of one of the core plates 1 fitting in the cooperating holes 4*a*' which are devoid of such flanges, so that a constant gap is formed between the upper end portions of adjacent flat tubes A. On the other hand, at the lower end portions of the flat tubes having no tank portions 3 of both core plates 1 abut each other, thus forming a gap of the same dimension between the lower end portions of the adjacent flat tubes A.

It is also to be noted that the described embodiment has means for preventing undesirable lateral slip or dislodgement of the core plates relative to each other. If the brazing joint surfaces 3*c* on the bent end portions 3 were flat, it is quite difficult to array the core plate 1 in correct positional relationship in the provisional assembly of the heat exchanger and, in addition, there is a risk of lateral sliding or dislodgement of the core plates 1 along their joint surfaces 3*c*. In order to maintain the required positional relationship between the core plates 1 while avoiding such a lateral dislodgement, the workers engaged in the assembly is required to pay much attention, which in turn considerably lowers the efficiency of the work and special jigs are required to prevent such sliding or dislodgement of the core plates 1. In the described and illustrated embodiment of the invention, however, the engaging recess 3*a* and projection 3*b* are formed in the bent end portion 3 of each core plate 1. These engaging recess 3*a* and the engaging projection 3*b* are so positioned that, when two adjacent core plates 1 are held together in the correct positional relationship, the engaging recess 3*a* and the engaging projection 3*b* of one of the core plates engage, respectively, with the engaging projection 3*b* and the engaging recess 3*a* of the other core plate 1, thereby correctly positioning two core plates 1 with respect to each other while avoiding any lateral slip or dislodgement of these core plates 1.

As stated before, the engaging recess 3*a* and the engaging projection 3*b* shown in FIGS. 5 and 6 have trapezoidal forms which provide following advantages:

Namely, if the engaging recesses 3*a* and the engaging projections 3*b* have simple rectangular forms, the engagement between the engaging recesses and engaging projections on both core plates cannot be attained easily unless these core plates are positioned precisely in alignment with each other. However, in the example shown in FIGS. 5 and 6, since the engaging recesses 3*a* and the engaging projections 3*b* have trapezoidal forms with their edges inclined at an angle $\theta$ with respect to lines perpendicular to the edge lines of the bent portions 3 as shown in FIG. 5, the engaging projections 3*b* on both core plates 1 can easily slide into corresponding engaging recesses 3*a* even if they are slightly offset from each other, so that the engagement between the engaging recesses 3*a* and the engaging projections 3*b* on both core plates can be attained very easily.

The angle of inclination $\theta$ of both edges of the engaging recess 3*b* and the engaging projection 3*a* is preferably selected to be as large as possible but should not exceed 60° in order to maximize the tolerance of the positional error in setting two core plates. Any inclination angle $\theta$ exceeding 60° undesirably increases the tendency of sliding or dislodgement of two core plates even by a small external force and impairs the effect of the engagement between the recesses 3*a* and projections 3*b*, i.e., the effect for preventing the slip or dislodgement of core plates with respect to each other. On the other hand, any inclination angle $\theta$ less than 10° undesirably impairs the effect for improving the assembling work, i.e., the effect for facilitating easy engagement between the engaging projections and recesses, although the effect for preventing the lateral dislodgement of the core plates is maintained. It is not always necessary that the depth of the engaging recess 3*a* and the height of the projection 3*b* are equal. Namely, no problem is caused even when the height of the engaging projection 3*b* is selected to be smaller than the depth of the engaging recess 3*a*. In addition, it is not essential that the engaging recesses and projections have trapezoidal forms. The number of the engaging recesses and projections may be increased as desired.

It is also to be understood that the engaging recesses 3*a* and engaging projections 3*b* may be formed in portions other than the bent end portion 3 of each core plate 1. Namely, such engaging recesses and projections may be provided on any portion of each core plate which constitutes a brazing joint surface provided that the presence of such engaging recesses and projections does not impair the strength or refrigerant gas tightness of the heat exchanger after brazing.

Figure 10:
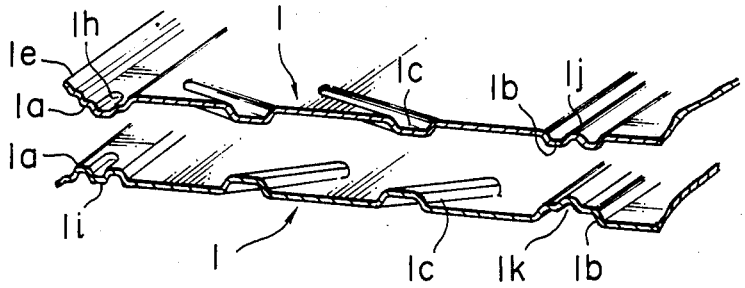
FIG. 10 is a fragmentary perspective view of a pair of core plates laid horizontally in spaced relationship, showing a different example of engaging projections and recesses.

A modification to the engaging recesses and projections is shown in FIG. 10. It will be seen that an engaging projection 1*h* is formed in the brazing joint surface 1*a* provided along the periphery of one of the core plates, while a cooperating engaging recess 1*i* is formed in the brazing joint surface 1*a* of the other core plate. The engaging projection 1*h* is adapted to be received in the engaging recess 1*i* so as to facilitate the positioning of two core plates with respect to each other and to prevent undesirable lateral dislodgement of the core plates relative to each other. The engaging projection and recess 1*h* and 1*i* can have any desired forms such as circular forms, oval forms and so forth.

Numerals 1*j* and 1*k* in FIG. 10 show engaging recess and engaging projection which are formed in the brazing joint surfaces of the longitudinal partitioning protrusions 1*b* formed on both core plates 1. The engaging recess 1*j* and the engaging projection 1*k* are adapted to mate with each other so as to facilitate the positioning of two core plates with respect to each other, while preventing undesirable lateral dislodgement of these core plates from each other. The engaging projections and recesses may be formed also in the abutting surfaces of the ribs 1*c* and 1*d* which are formed on core plates for the purpose of defining refrigerant labyrinth passages and also for the purpose of reinforcement.

Figure 12:
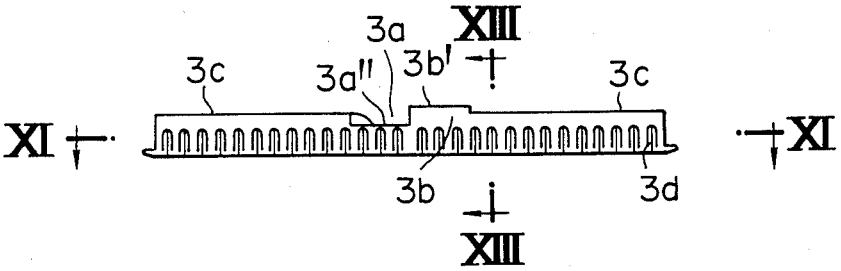
FIG. 12 is a bottom view of the core plate shown in FIG. 11.
Figure 13:
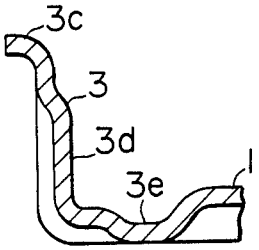
FIG. 13 is an enlarged sectional view taken along the line XIII—XIII in FIG. 12.
Figure 11:
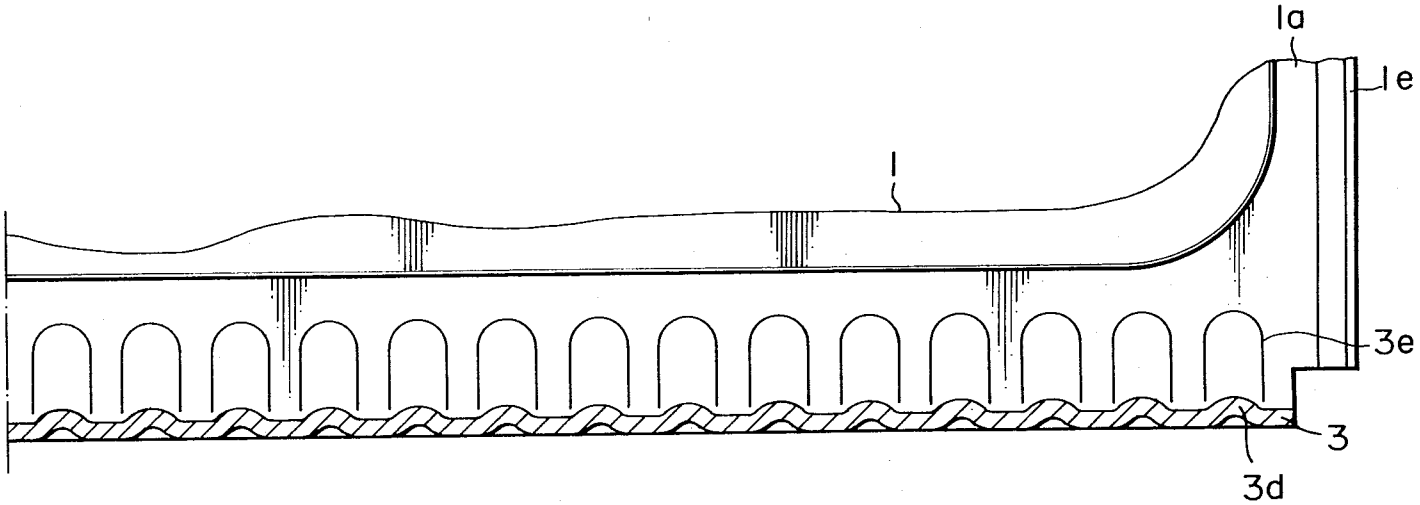
FIG. 11 is an enlarged sectional view taken along the line XI—XI in FIG. 12, showing a different form of bent portions of the core plate.

FIGS. 11 to 13 show a different embodiment of the invention in which ribs 3*d* are formed by corrugating the bent end portion 3 at the lower end of each core plate 1 and ribs 3*e* are formed also on the portions of the flat surface of the core plate adjacent to the ribs 3*d*. According to this arrangement, the rigidity of the core plate in the bent end portion 3 is increased to thereby prevent any thermal distortion of the bent end portion 3 which may otherwise be caused by the heat applied during the brazing.

The crease line between the bent end portion 3 and the adjacent end portion of the core plate 1 may alternatively be curved other than being straight. Such an alternative embodiment, though not shown, is effective to increase the rigidity of the core plate 1 in a zone thereof adjacent to such a curved crease line to thereby similarly prevent the occurrence of such a thermal distortion as mentioned above.

Figure 14:
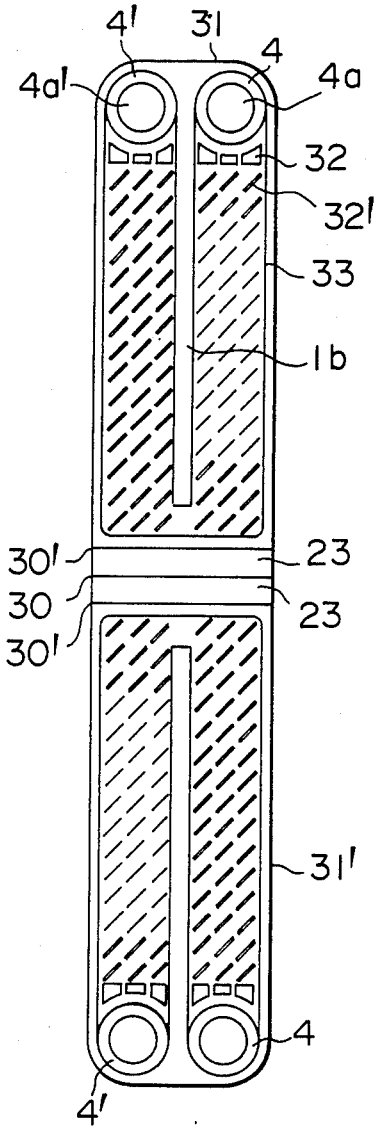
FIG. 14 is a front elevation of another embodiment of the core plate.
Figure 15:
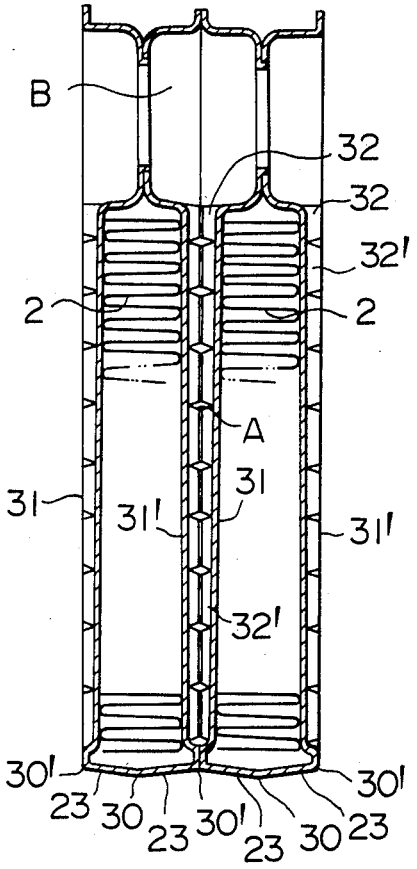
FIG. 15 is a vertical sectional view of a part of a heat exchanger constructed with core plates of the type shown in FIG. 14.
Figure 16:
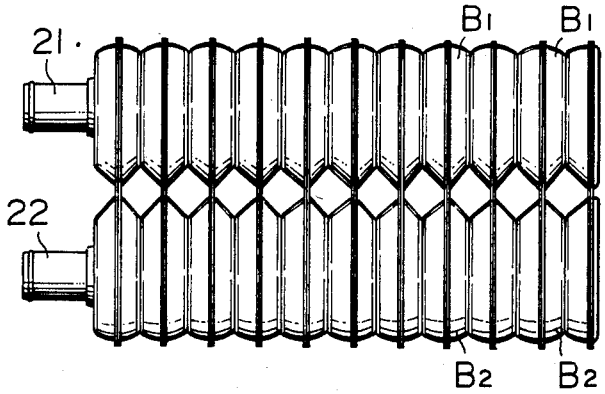
FIG. 16 PRIOR ART
FIGS. 16 and 17 are a top plan view and a front elevational view of the prior art heat exchanger, respectively.

FIG. 14 shows an essential portion of a different embodiment of the heat exchanger in accordance with the invention. In this Figure, the same reference numerals are used to denote the same parts or members as those incorporated in the preceding embodiments. Thus, description of the same parts or members is omitted. In this embodiment, a core plate unit is constituted by a pair of core plates 31 and 31 which are formed integrally with each other such that the protrusions 4 and 4′ for forming tank portions are positioned on the opposite ends of the core plate unit as shown in FIG. 14. Reference numerals 32 and 32′ denote reinforcement ribs, while a numeral 33 designates a brazing joint surface on the periphery of each core plate. A central folding line 30 is formed in the center of a web-like portion by which two core plates 31 and 31′ are integrally connected together, while two bending lines 30′ are formed adjacent to respective core plates 31 and 31′. The areas 23 each defined between the central folding line 30 and one of the bending lines 30′ constitutes a bent end portion similar to the bent end portions 3 in the preceding embodiments. In the assembly of the heat exchanger, each core plate unit constituted by the two core plates 31 and 31′ shown in FIG. 14 is folded about the central folding line 30 and is then bent about the two bending lines 30′, so that two core plates 31 and 31′ are brought together with a corrugated fin 2 interposed therebetween, as shown in FIG. 15, to form a sub-assembly which is then jointed to another sub-assembly which has been formed separately, whereby a flat tube A is formed by adjacent core plates 31′ and 31 of two core plate units, as shown in FIG. 15. In this way, it is possible to assemble a heat exchanger having a plurality of flat tubes A, without requiring any separate spacer or supporting member which was required in the prior art to maintain a constant gap between each adjacent pair of flat tubes.

Figure 17:
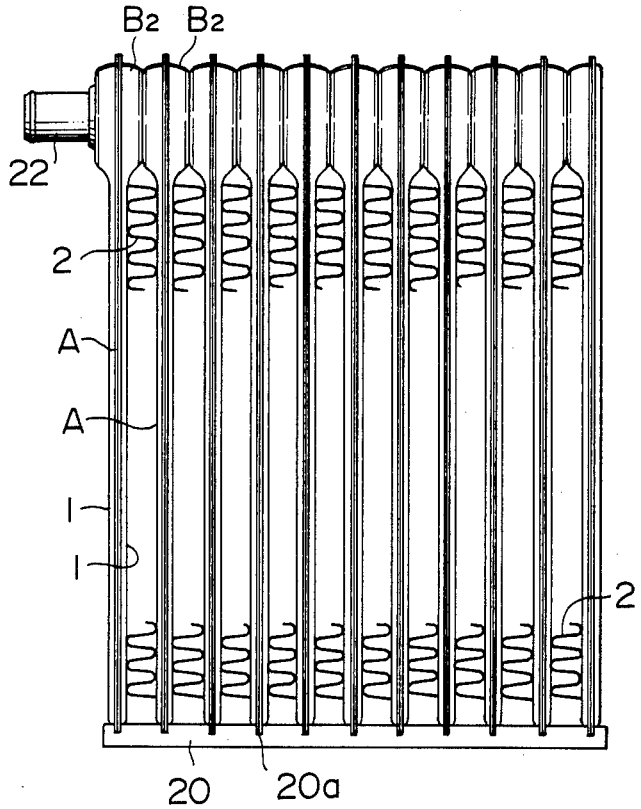
FIG. 17 PRIOR ART
Figure 18:
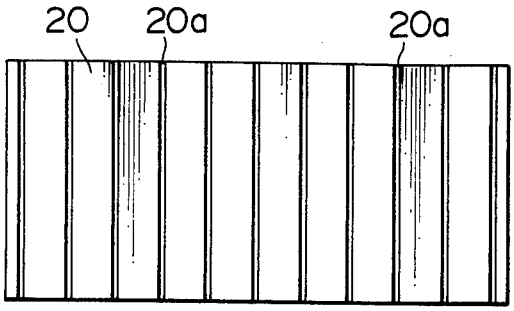
FIG. 18 PRIOR ART
FIGS. 18 and 19 are a plan view and a side view of a supporting member incorporated in the prior art heat exchanger shown in FIGS. 16 and 17.
Figure 19:
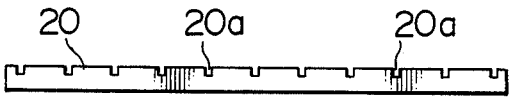
FIG. 19 PRIOR ART

Namely, in the prior art heat exchanger shown in FIGS. 16–19, a constant gap is maintained between each adjacent pair of flat tubes A at the upper end portion as viewed in FIG. 17 by virtue of the presence of the tank portions B1 and B2, as in the present invention. At the lower end portion of the heat exchanger, however, the prior art heat exchanger incorporates a supporting plate 20 formed therein with a plurality of notches 20*a* for receiving the lower ends of the flat tubes A. The use of the supporting plate 20, however, imposes various problems as discussed in the introductory portion of this specification.

It will be understood that such problems and difficulty are eliminated in the heat exchanger of the invention because the necessity for the separate supporting member for maintaining constant spaces between adjacent flat tubes is eliminated. In consequence, the invention contributes to a reduction in the cost as well as weight and improves the efficiency of the assembling work.

What is claimed is:

1. A multi-layer type heat exchanger including:

a row of a plurality of substantially parallel flat tubes each formed by two core plates prepared by press work and sealingly jointed together;

each flat tube including a pair of tank portions spaced widthwise of the flat tube and formed by protrusions formed in one end of each of the two core plates of the flat tube and protruding laterally outwardly of the flat tube;

the protrusions on each core plate defining therein holes providing inlet and outlet for a heat transfer fluid;

each flat tube defining therein a passage for said heat transfer fluid, said passage being communicated at its opposite ends with said tank portions and arranged such that said heat transfer fluid flows from one of the two tank portions into said passage towards the other end of said flat tube and is turned and flows to the other tank portion;

the flat tubes being successively stacked in the direction of the thickness of each flat tube so that the protrusions on each core plate of each flat tube, excepting the outermost core plates, abut against the protrusions of an adjacent core plate of an adjacent flat tube and the holes in the abutting protrusions are sealingly connected with each other;

a corrugated fin interposed between and secured to adjacent core plates of each adjacent pair of flat tubes; and adjacent core plates of each adjacent pair of flat tubes having bent end portions extending towards and engaging each other to support, in spaced relationship, the other ends of the adjacent flat tubes in the direction of the thicknesses thereof and prevent the corrugated fin therebetween from being collapsed.

2. A heat exchanger according to claim 1, wherein said bent end portions have engaging recesses and projections such that said engaging recesses and projections engage with each other to thereby prevent adjacent core plates from being dislodged one from the other.

3. A heat exchanger according to claim 2, wherein each of said engaging recesses and projections have a trapezoidal form.

4. A heat exchanger according to claim 1, wherein the two core plates of each flat tube have soldered joint surfaces extending along substantially the outer peripheries of the core plates and said joint surfaces are provided with projections and recesses engaged to prevent the core plates from being dislodged one from the other.

5. A heat exchanger according to claim 4, wherein the two core plates of each flat tube are provided with partitioning protrusions disposed inwardly of said joint surfaces and longitudinally extending from a point between the tank portions towards said the other end of the flat tube, the partitioning protrusions on the two core plates being provided with recess and projection engaged to prevent the two core plates from being dislodged one from the other in the widthwise direction of the core plates.

6. A heat exchanger according to claim 1, wherein the bent end portions of the two core plates of each flat tube are provided with ribs and wherein said the other end portion of each core plate is also provided with ribs adjacent to said bent end portion, whereby the rigidity of each core plate in said the other end portion and said bent end portion is increased to prevent thermal distortion of the core plate.

7. A heat exchanger according to claim 1, further including at least one protecting plate and a further corrugated fin, said protecting plate being secured to one of the outermost core plates of the heat exchanger with said further corrugated fin interposed between said protecting plate and said one outermost core plate, said protecting plate having a bent end portion extending towards and engaged with the bent end portion of said one outermost core plate to assure that said protecting plate is spaced from said one outermost core plate a distance sufficient to accommodate said further corrugated fin.

8. A multi-layer type heat exchanger including:

a row of a plurality of substantially parallel flat tubes each formed by two core plates prepared by press work and sealingly jointed together;

each flat tube including a pair of tank portions spaced widthwise of the flat tube and formed by protrusions formed in one end of each of the two core plates of the flat tube and protruding laterally outwardly of the flat tube;

the protrusions on each core plate defining therein holes providing inlet and outlet for a first heat transfer fluid;

each flat tube defining therein a first passage for said first heat transfer fluid, said passage being communicated at its opposite ends with said tank portions and arranged such that said heat transfer fluid flows from one of the two tank portions into said first passage towards the other end of said flat tube and is turned and flows to the other tank portion;

the flat tubes being successively stacked in the direction of the thickness of each flat tube so that the protrusions on each core plate of each flat tube, excepting the outermost core plates, abuts against the protrusions of an adjacent core plate of an adjacent flat tube and the holes in the abutting protrusions are sealingly connected with each other;

a corrugated fin disposed between and secured to adjacent core plates of each adjacent pair of flat tubes; and adjacent core plates of each adjacent pair of flat tubes having bent end portions extending to and integrally connected with each other to support, in spaced relationship, the other ends of the adjacent flat tubes in the direction of the thicknesses thereof and prevent the corrugated fin therebetween from being collapsed.

* * * * *